United States Patent [19]

Selak

[11] Patent Number: 4,676,497

[45] Date of Patent: Jun. 30, 1987

[54] SHEET CONVEYOR AND COOPERATING ROLLER

[76] Inventor: Martin Selak, 578 S. Warrington Rd., Des Plaines, Ill. 60016

[21] Appl. No.: 584,791

[22] Filed: Feb. 29, 1984

Related U.S. Application Data

[62] Division of Ser. No. 273,573, Jun. 15, 1981, Pat. No. 4,437,657.

[51] Int. Cl.[4] ..... B65H 9/14

[52] U.S. Cl. ..... 271/226; 271/229; 271/272

[58] Field of Search ..... 271/272, 274, 198, 200, 271/224, 229, 245, 246, 220, 226; 198/836

[56] References Cited

U.S. PATENT DOCUMENTS 4,163,550 8/1979 Armstrong ..... 271/274

4,183,518 1/1980 Brockmüller et al. ..... 271/182

4,260,148 4/1981 Diesch et al. ..... 271/224 X

*Primary Examiner*—Joseph J. Rolla

*Assistant Examiner*—David H. Bollinger

*Attorney, Agent, or Firm*—Russell E. Hattis

[57] ABSTRACT

Sheet conveyor apparatus for feeding sheets one at a time to a stop wall at the end of the conveyor with at least one overhead support extending above said conveyor. An overhead longitudinally adjustable roller carrying sub-assembly extends above the conveyor supported on the overhead support. The sub-assembly is comprised of a roller which engages a sheet of material moving on the conveyor and positioned to prevent "bounce back" thereof as the sheets are moved against the stop wall. The rollers are carried on resilient arms which may be adjusted to vary the downward force of the roller upon the sheet moving on the conveyor.

5 Claims, 21 Drawing Figures

Fig 4
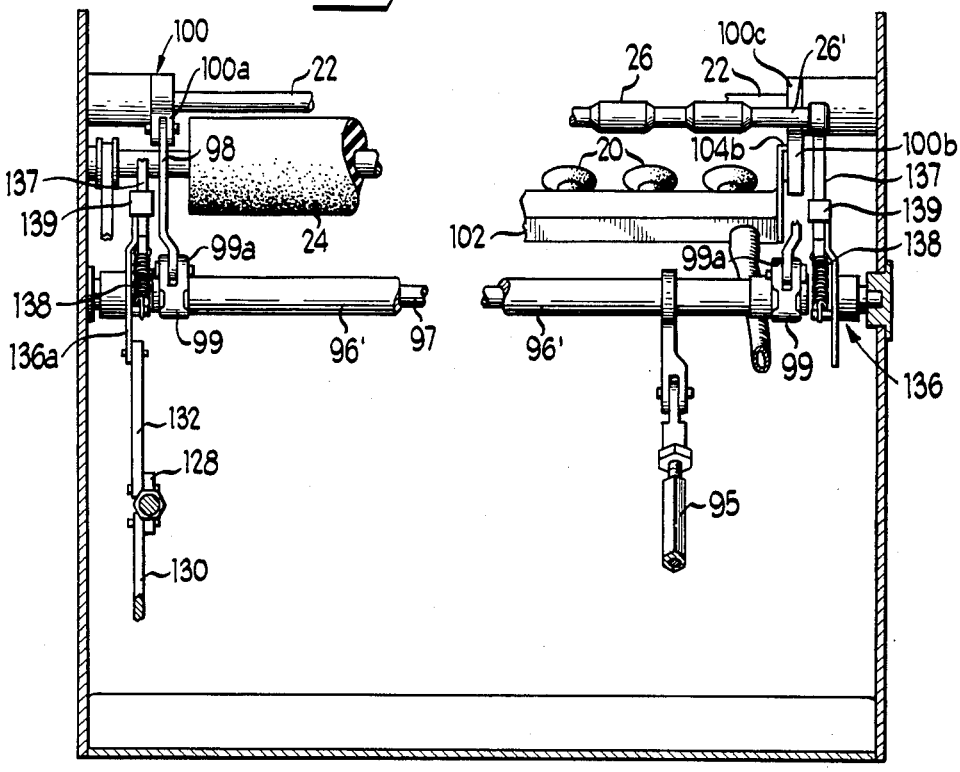
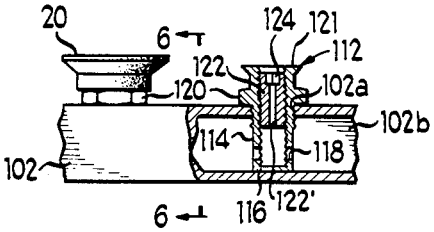
Fig 5
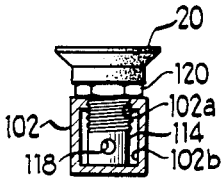
Fig 6
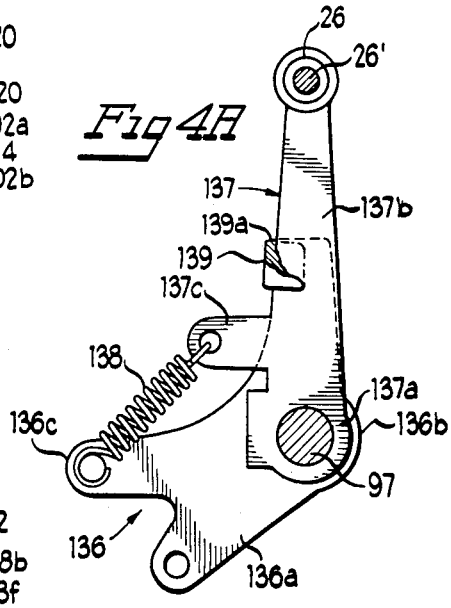
Fig 4A
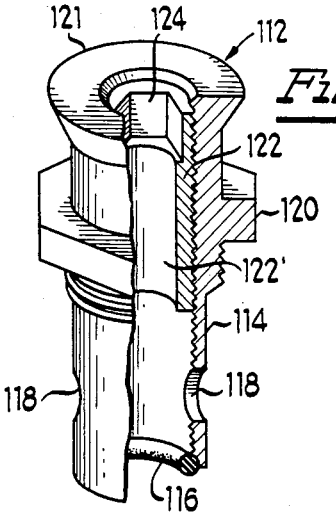
Fig 7
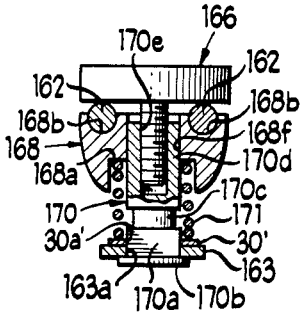
Fig 16

Fig 8
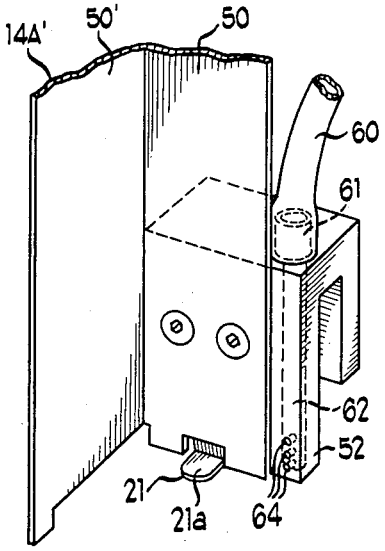
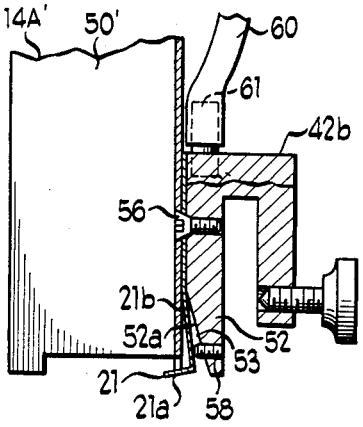
Fig 9
Fig 12
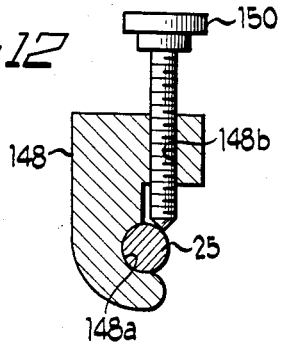
Fig 13
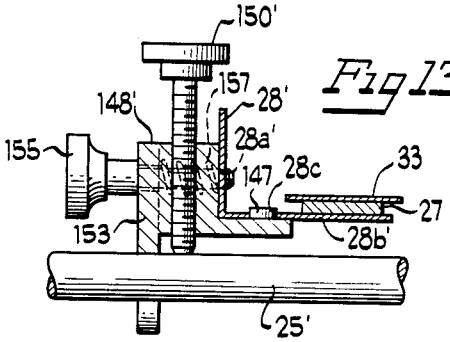
Fig 15
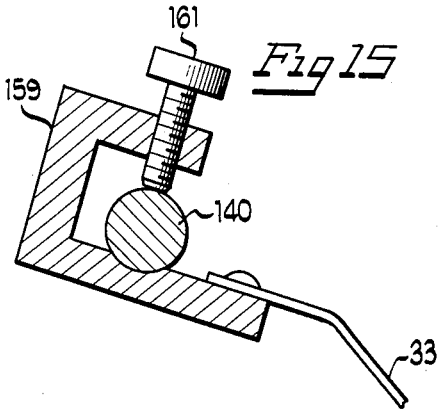
Fig 14
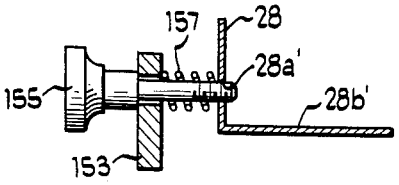

SHEET CONVEYOR AND COOPERATING ROLLER

REFERENCE TO RELATED APPLICATION

This application is a divisional application of Ser. No. 273,573, filed on June 15, 1981 now U.S. Pat. No. 4,437,657.

BACKGROUND OF THE INVENTION

The present invention is an improvement over the envelope and sheet feeding apparatus disclosed in U.S. Pat. No. 3,934,868. As disclosed therein, the feeding apparatus includes three widely spaced suction cups supported on individual arms movable between an initially lowered position and a raised position where the suction planes of the suction cups are parallel to and engage the bottom exposed surface of the bottommost sheet in a stack of the same held in a top loadable stacking frame, so that the operation of the apparatus does not have to be interrupted when the supply of sheets is to be replenished. The stack of sheets preferably rests on a slightly forwardly inclined support tray which terminates short of the lower front end of the stack to leave an opening running the entire width of the stack to expose thereat the bottom sheet in the stack for engagement by one or more of the suction cups. The front end of the stack rests on a rigid support ledge so that when the bottommost sheet is pulled from the stack by the lowering of the suction cups, the weight of the stack above the same will tend to maintain this mext sheet within the stacking frame. The suction applied to the suction cups is released in the lowermost position thereof where the sheet is applied to a feed or drive roller which directs the sheet to other sheet feeding apparatus.

The aforementioned drive roller generally feeds sheets one at a time from each stack thereof to a conveyor, which is frequently a belt conveyor, which delivers the same to a terminal point where each sheet so delivered is received by a sheet pick-up member associated with the printing or other equipment which is to handle and process the sheets. The front margin of each sheet should desirably come to rest against this abutment wall. Any "bounce-back" of a sheet as it is moved against this wall can alter the desired longitudinal position of the sheet which can interfere with the proper processing thereof by the sheet receiving equipment involved. Accordingly, another object of the invention is to provide a reliable means for inhibiting "bounce-back" of a sheet as it is delivered to the terminal point of the conveyor, and which is adaptable to sheet material of various thicknesses and flexibilities.

SUMMARY OF THE INVENTION

One aspect of the invention to be described deals with a unique pressure roller support construction pressing down upon the sheet on the conveyor of the apparatus. This support construction enables the roller to be pivoted to opposite longitudinal positions to ideally position the same and provides means for adjusting a downwardly directed spring force on the roller so that the desired force is applied to the sheets of a selected thickness and weight. Two or more such adjustable rollers are positioned along the path of travel of the sheets on the conveyor, the forwardmost of which presents "bounce back" of the sheet delivered to the abutment wall previously described.

The above and other objects, advantages and features of the invention will become apparent upon making reference to the specification and claims to follow and the drawings.

DESCRIPTION OF DRAWINGS

FIG. 4 is a vertical transverse sectional view through the sheet feeding apparatus, taken along section line 4—4 in FIG. 2;

FIG. 4A is an enlarged side elevational view of the rockable pressure roller moving and supporting lever members shown also in FIGS. 2 and 4;

FIG. 5 is a fragmentary elevational view through the rectangular pneumatic tube which carries the suction cups, the tube being broken away to show the mounting structure for the suction cups;

FIG. 6 is a transverse sectional view through the pneumatic tube, taken along section line 6—6 in FIG. 5;

FIG. 7 is a greatly enlarged perspective view of one of the suction tube support members, which threads into openings in the top of the pneumatic tube;

FIG. 8 is a fragmentary perspective view of one of the front support ledge-carrying upstanding guide members at the loading section of the apparatus;

FIG. 9 is a fragmentary vertical sectional view through the upstanding guide member of FIG. 8;

FIG. 12 is a sectional view through one of the clamps which locks one of the vertical guide walls in position on a cross rod of the conveyor section, taken along section line 12—12 in FIG. 3;

FIG. 13 is a sectional view through the clamp and pivot pin associated with the other vertical guide wall of the conveyor section which permit adjustment of the angle of and clamps the wall in place, as taken along section line 13—13 in FIG. 3;

FIG. 14 is a sectional view through the adjustment screw which adjusts the angle of the latter guide wall;

FIG. 15 is a sectional view through one of the clamps which locks one of the envelope hold-down bands on a cross rod in the conveyor section, taken along section line 15—15 in FIG. 3;

FIG. 16 is a vertical sectional view through the support structure for one of the hold-down rollers of the conveyor section, taken along section line 16—16 in FIG. 3.

GENERAL DESCRIPTION OF EXEMPLARY FORM OF THE INVENTION

Figures 1, 2:
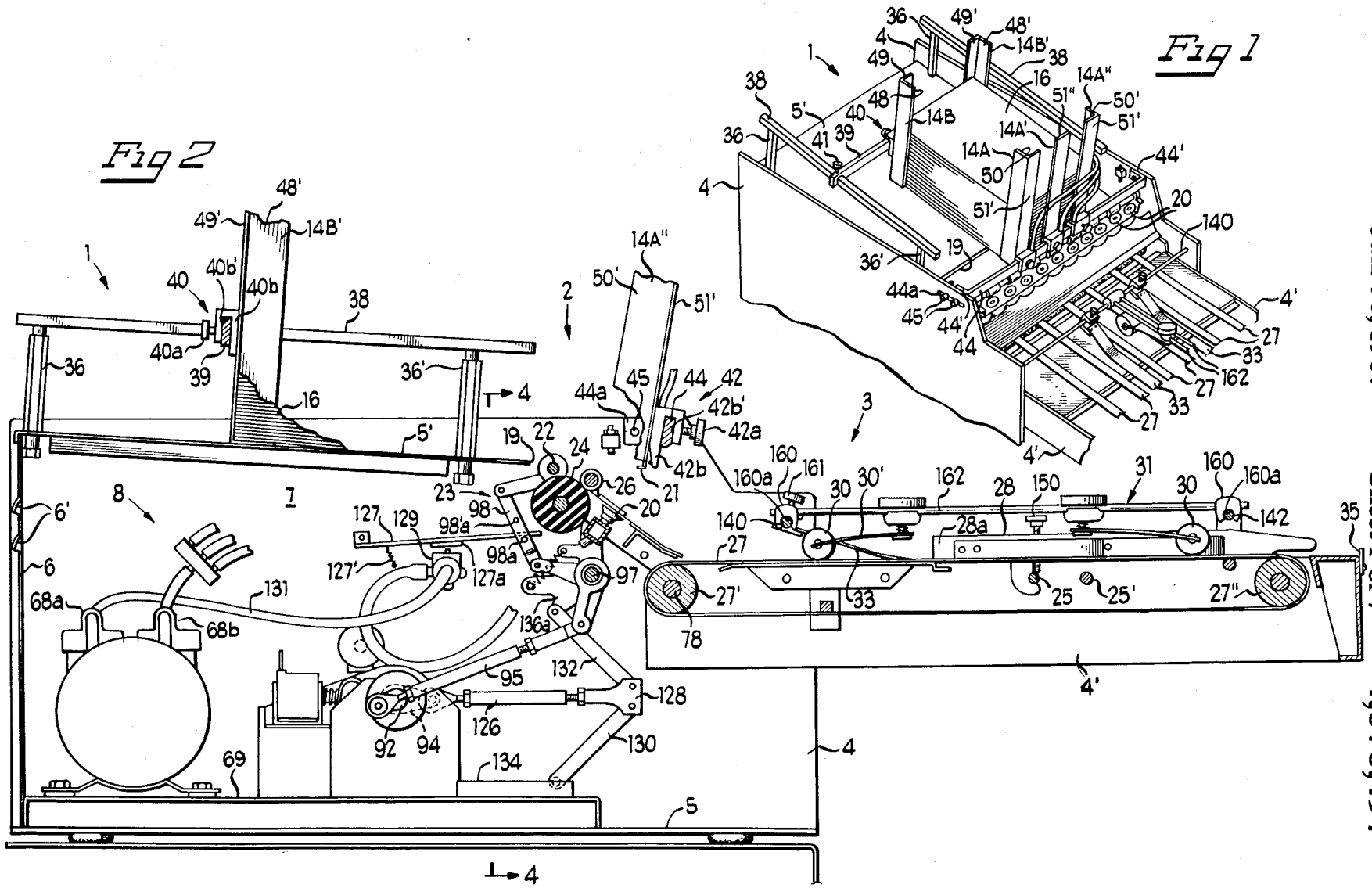
FIG. 1 is a perspective view of the sheet feeding apparatus of the invention.
FIG. 2 is a longitudinal sectional view through the sheet feeding apparatus of FIG. 1.

Referring now more particularly to FIGS. 1 and 2, the sheet feeding apparatus of the invention illustrated therein comprise a loading section 1, a sheet feeding section 2 and a conveyor section 3 contained within and upon a housing and support framework. The apparatus forms a completely self-contained unit with its own drive power. However, many aspects of the invention are useful in a piece of equipment which is driven by a motor drive forming part of the equipment with which the sheet feeding apparatus is used, such as the feeding equipment disclosed in said U.S. Pat. No. 3,934,868.

The housing portion of the apparatus, which forms a partial enclosure, is formed by longitudinal side walls 4—4, a rear vertical wall 6 having louvers 6' communicating with the housing interior compartment 7, a bottom wall 5 and a slightly forwardly and downwardly inclining top wall 5' which forms a support tray for one or more stacks of sheet material to be fed one at a time from the bottom of each stack. (Reference to sheets or sheet material is intended to encompass envelopes, as well as individual single thickness sheets of material, having widely varying degrees of thickness and flexibility.) Supported within the compartment 7 are various mechanical and electrical devices generally indicated by numeral 8 for operating the various parts of the apparatus to be described.

The loading section is adapted to support, for both lateral al and longitudinal adjustment upstanding forward guide members 14A, 14A' and 14A" and upstanding rear guide members 14B—14B' which confine a stack of sheets of widely varying dimensions. While the drawings illustrate a single stack of sheets 16 at the loading station, two or more stacks of narrower sheets could be so supported by adding more guide members. The support tray 5' on the bottom of the loading station 1 terminates short of an adjustable support ledge formed by spring fingers 21 (FIGS. 2, 8 and 9) confronting the feed opening 19 and carried by the front upstanding guide members. The widths of the ledge formed by the spring fingers 21 is variable in a manner to be described.

The bottommost sheet of each stack of sheets involved is withdrawn downwardly from the stack by suction cups 20 supported on carrier means moved by various rockable links and levers 23 to be described, which effect the raising of the suction cups 20 from a lowered position to a raised position within the feed opening 19, during which vacuum is applied to suction cups 20 so that the suction cups will attach themselves to the bottommost sheet in the stack and, upon subsequent downward movement thereof, will withdraw only this sheet from the stack. The various positions and orientations imparted to the suction cups 20 to be described constitute an important feature of the invention. An idler roller 22 extends slightly above the level of the support tray 5' so that the bottommost sheet normally rests thereon. The suction cups in their lowered positions pull the sheet involved down upon a drive roller 24, whereupon pressure rollers 26 rotatably carried on a common shaft 26' are raised to press the sheet against the drive roller 24, which then feeds the sheet involved to the conveyor section 3.

The conveyor section 3 is shown as including laterally spaced conveyor belts 27 extending around drive and driven pulleys 27' and 27". The lateral position of the sheets delivered one at a time to a particular section of the conveyor belts 27 are laterally constrained by vertical guide means 28—28' which are adjustable in lateral position on cross rods 25—25' extending between horizontal side walls 4'—4' secured to and projecting forwardly from the side walls 4—4. Each sheet passes under one and preferably a pair of pressure rollers 30—30 carried by an overhead carrier assembly 31. Where the sheet involved are envelopes, the envelopes are held down also by bands 33—33 laterally adjusted in position.

The sheet delivered from each stack of sheets is fed by the conveyor against a vertical stop wall 35 without "bounce back" so that the sheet may be picked up by pick-up equipment associated with printing or other apparatus to which the sheet material is to be delivered. The stop wall 35 is removable so that the sheet material can be delivered directly into such related equipment, if desired. The control equipment within the compartment 7 may include means responsive to the feeding of an external timing pulses which initiates a single sheet feeding cycle, so that the sheet feeding apparatus is synchronized with the related printing or other equipment.

Now that the basic parts of the sheet feeding apparatus have been introduced, the details thereof for the preferred form of the invention illustrated in the drawings will now be described.

Loading Section 1

Referring now more particularly to FIGS. 1 and 2, the loading section includes a framework upon which the upstanding guide members 14A, 14A', 14A", 14B and 14B' are mounted. This framework includes a pair of upstanding rail support posts 36 extending upwardly from the rear sides of the support tray 5' and a pair of upstanding rail support posts 36' extending upwardly from the front sides of the support tray 5'. A horizontal rail 38 extends between posts 36 and 36' on one side of the support tray 5' and a rail 38 extends between the posts 36 and 36' on the other side of the support tray 5'. Slidably supported along and between the rails 38 is a cross rail 39, which has channels on the ends thereof which receive the rails 38, and clamping screws 41 which clamp the cross rail 39 in any selected longitudinal position along the associated rails 38. The cross rail 39 carries the rear upstanding guide members 14B and 14B'. Viewed from the conveyor side of the loading station, the upstanding guide member 14B is adapted to receive the rear left corner portion of the stack of sheets involved, and the upstanding guide member 14B' is adapted to receive the rear right corner of the stack of sheets. These guide members 14B and 14B' are angle bars providing longitudinally extending surfaces 48—48' which engage the longitudinal sides of the stack of sheets and transversely extending surfaces 49—49' which engage the rear end of the stack of sheets. Each of the upstanding guide members 14B and 14B' has guide and clamping means 40 for securing the associated guide member in any adjusted position on the rail 39. Each guide and clamping means includes a channel bracket 40*b* with a downward opening channel 40*b*' adapted to receive the rail 39 and a clamp screw 40*a* which threads through the bracket to engage the rail 39. As illustrated, the rail 39 is of a sufficient length to accommodate two pairs of complimentary upstanding guide members 14B—14B' so that two laterally spaced stacks of sheets can be supported on the support tray 5'.

It can be seen that, viewing the loading section from the conveyor side thereof, the left upstanding guide member 14A is adapted to receive the left front corner of the stack of sheets and the right upstanding guide member 14A' is adapted to receive the right front corner of the stack of sheets. Accordingly, these guide members made of angle bars have confronting longitudinal surfaces 50—50' which engage the longitudinal sides of the stack of sheets and lateral surfaces 51—51' which engage the front end of the stack of sheets.

The intermediate upstanding guide member 14A' is shown as comprising a vertical strip of metal which provides a surface 51" which engages the front end of the stack of sheets. This upstanding member is not normally needed where relatively narrow sheets of material are to be stacked.

The front upstanding guide members 14A, 14A'and 14A" are mounted for lateral adjustment on a cross rail 44 positioned in confronting relation to the feed opening 19 at the front of the support tray 5'. Cross rail 44 has end flanges 44' each with a pair of horizontally spaced openings alignable with adjacent horizontal slots **44*a* formed in the side walls 4. Locking screws or bolts 45 pass through the slots 44*a* and engage with the rail flanges 44' either by threading into threaded openings therein or by receiving nuts on the insides of the flanges. The cross rail 44 is thus longitudinally adjustable along the front margin of the feed opening 19 defined by the general location of the cross rail 44. The upstanding guide members 14A, 14A' and 14A" are slidably supported upon rail 44 by guide and clamping means 42 similar to the means 40 and each comprising a channel bracket 42*b* having a downwardly opening channel 42*b'* slidably receiving the cross rail 44, and a clamping screw 42*a* for locking the channel bracket in any desired position along the rail 44**.

Thus, the rear upstanding guide members 14B—14B' are adjustable both laterally and longitudinally of the loading section and, as is very unique and advantageous, the rail 44 carrying the upstanding front guide members 14A, 14A' and 14A" adjustable longitudinally over a limited distance for reasons other than accomodating sheets of different dimensions in a longitudinal direction, which could be accommodated solely by the longitudinal adjustment of the rear cross rail 39 upon the longitudinal rails 38.

Thus, as will be explained in some detail hereafter, this longitudinal adjustability of the rail 44 is to provide some adjustment of the points adjacent the front end of the bottommost sheet of the stack which is to be engaged by the suction cups 20. This is particularly important where envelopes are the sheet material involved and the envelopes are oriented with the closure flaps facing downwardly, as is most commonly the case where printing is to be done on the top side thereof. As previously indicated, it is desired that the suction cups 20 engage the bottom face of the envelope at points wholly within the margins of the flaps.

The front upstanding guide members 14A, 14A' and 14A" have a very unique and advantageous construction best illustrated in FIGS. 8 and 9, wherein is shown the bottom construction of the righthand upstanding member 14A', it being understood that the bottom portion of the other front upstanding guide members 14A and 14A" have the same construction as there shown. Thus, each of these members has an adjustable spring finger support lip 21 at the bottom thereof which supports the bottom of the front ends of the sheets of material involved in a manner to assure that only one sheet at a time is fed from the stack involved by the suction cups 20. Each spring lip **21*a* extends laterally from a vertical support arm 21*b*. The vertical arm 21*b* is sandwiched between the rear leg 52 of the channel bracket 42*b* and the adjacent wall of the associated upstanding guide member. A locking screw 56 threading into an opening in the bracket leg 52 securely clamps the upper portion of the vertical arm 21*b* in place. The bottom end of the bracket leg 52 has a tapered portion 52*a* which forms a clearance space 53 in which the lower portion of the vertical arm 21*b* may be moved in a longitudinal direction by the adjustment of a screw 58 threading into an opening in the bottom portion of the bracket leg 52. Thus, by rotating the adjusting screw 58, the degree to which the support ledge-forming spring finger 21*a*** projects rearwardly beyond the adjacent wall of the upstanding guide member which engages the front end of the stack of sheets is varied to accommodate sheets of different stiffness and flexibility, as previously explained.

As best shown in FIG. 8, air discharge openings 64 communicate with a vertical passage 62 in the bracket leg 52, the vertical passage 62 terminating in an upwardly projecting hollow nose portion 61 adapted to slidably receive therearound an air inlet tube 60. This air inlet tube 60 provides a continuous stream of air directed horizontally through the openings 64 to aid in separating the sheets of the stack of material involved at the point where the bottommost sheet is to be separated from the sheet above the same during the sheet withdrawal operation to be described. The air inlet tube 60 associated with the front upstanding guide members 14A, 14A' and 14B', as shown in FIG. 1, extend to the air outlet **68*b* of a pump 68 supported on a raised platform 69 resting on the bottom wall 5 of the housing of the apparatus. Pump 68 has an air return or suction portion 68*a* at which return air enters the pump. This suction point is connected to a control valve to be described which controls the feeding of suction to the suction cup 20**.

Feeding Section 2

Figure 3:
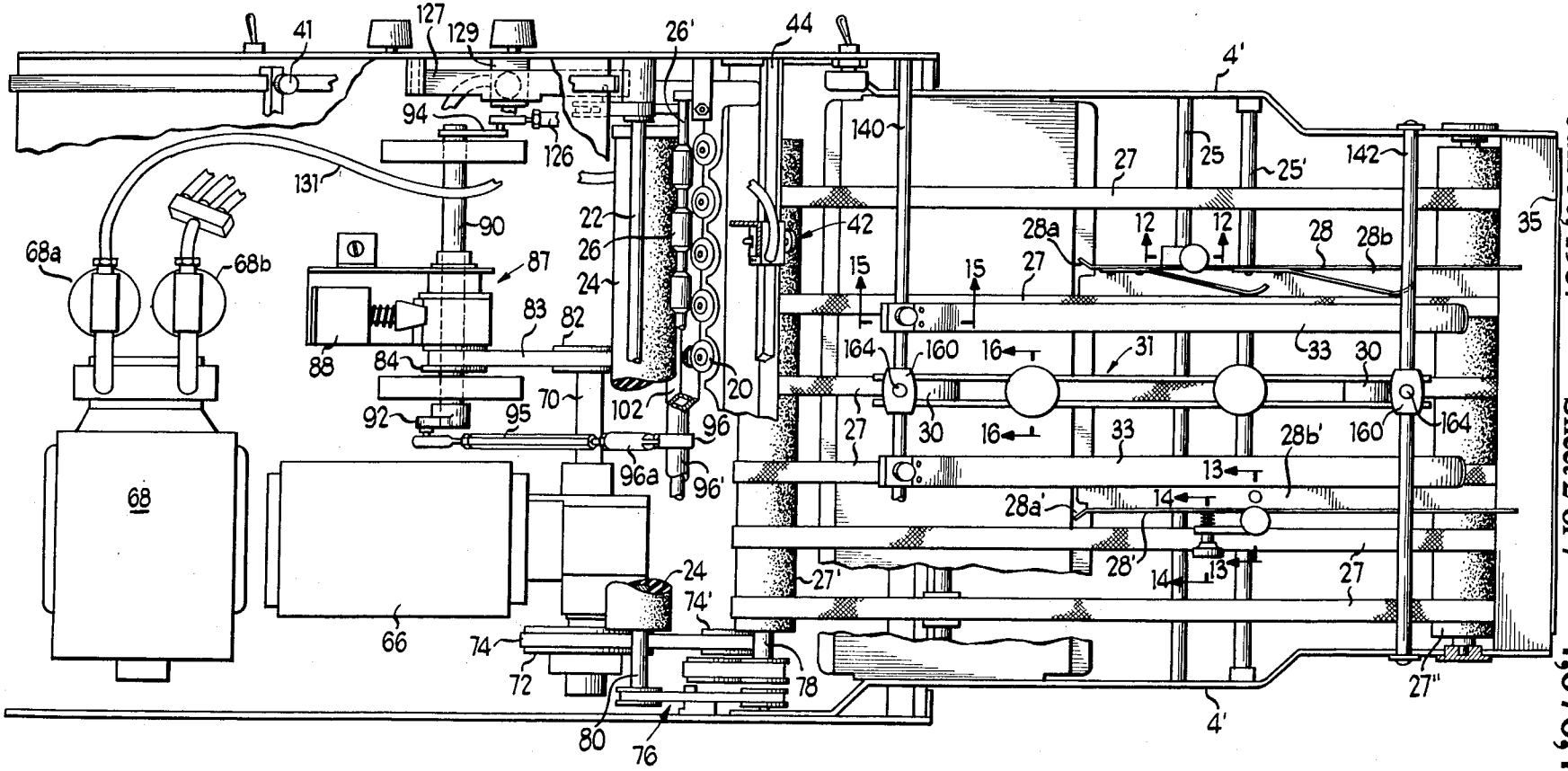
FIG. 3 is a partially broken away plan view of the sheet feeding apparatus of FIG. 1.

Drive power for the feeding section of the sheet feeding apparatus of the exemplary form of the invention being described is best shown in FIGS. 2 and 3, to which reference is now made. An electric motor 66 imparts continuous rotation to a drive shaft 70 having a pulley 72 at one end thereof which drives a belt 74 extending over another pulley 74'. A pulley and belt transmission generally indicated by reference numeral 76 operates drive shafts 78 and 80 respectively carrying the aforementioned pulley 27' and drive roller 24.

The motor driven shaft 70 carries a pulley 82 at the opposite end thereof around which extends a drive belt 83 extending around a pulley 84 which continuously drives a clutch mechanism 87 controlled by a solenoid 88 which receives pulses from an external control source, such as a printing machine each pulse starts a single cycle of operation of the linkage mechanism to be described, where shaft 90 carrying cranks 92 and 94 on the ends thereof are rotated 360° for each pulse received by the solenoid 88. Such a single cycle transmission is well known in the art and so the details thereof will not be described.

The crank 92 on one end of the shaft 90 reciprocates a crank arm 94 which rocks a lever member 96 by its connection to a lever arm 96*a* thereof. The lever member 96 is secured to a sleeve 96'. As best shown in FIG. 4, the sleeve 96' is connected at opposite end portions thereof to identical lever members 99 each having lever arms 99*a* in turn, secured to link arms 98. The link arms 98 are secured to lever arms 100*a* of lever members 100 having hubs 100*c* rotatably mounted about the same axis as the idler rollers 22. Lever members 100 have lever arms 100*b* to which are pivotally mounted and carried a pneumatic tube 102 carrying the suction cups 20 in a manner to be described. As the rotation of crank 92 reciprocates the crank arm 94, the various lever members and linkages described are rocked back and forth to raise or lower the lever arms 100*b* and the pneumatic tube 102.

Figure 10A:
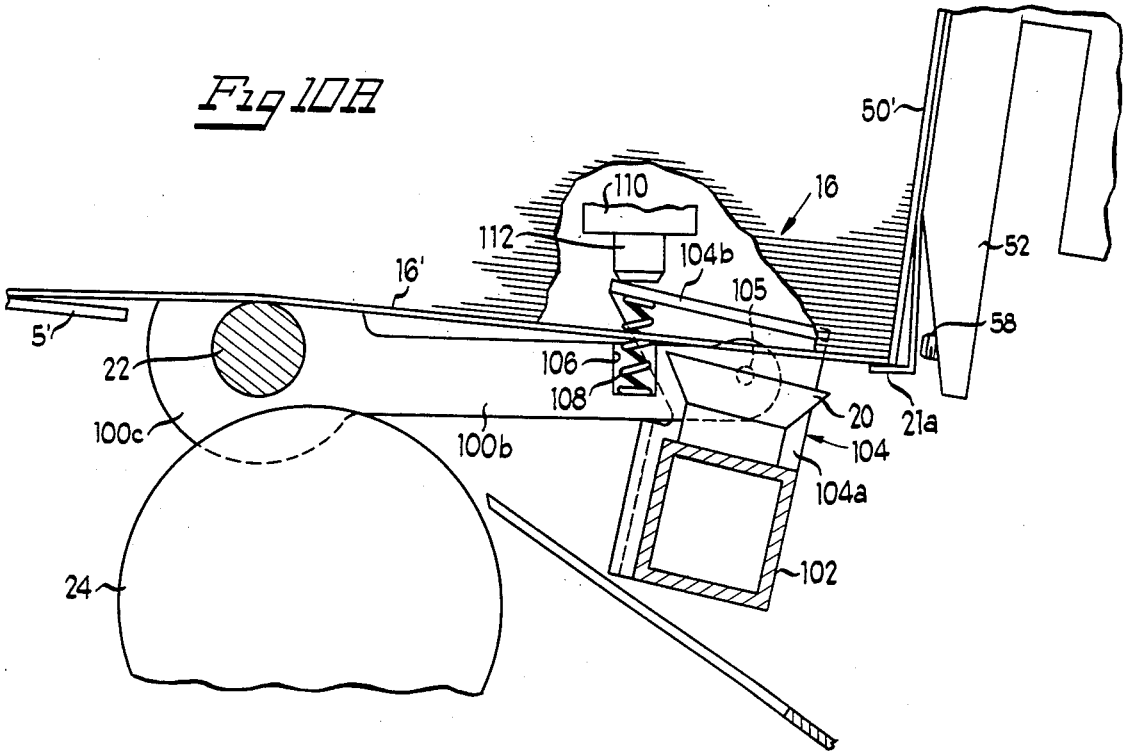
FIGS. 10A, 10B, 10C, 10D and 10E respectively show the different positions of the suction cups, the pneumatic tube carrying the suction cups and rockable support arms for carrying the pneumatic tube respectively (a) when the suction cups are slightly spaced from the bottommost sheet in the stack, (b) when the suction cups make initial contact with the bottom sheet in the stack, (c) when the suction cups are raised and tilted from position (b), (d) when the suction cups have been lowered to a point where the bottommost sheet wipes past the ledge-forming lips normally supporting the front end of the stack involved, and (e) when the suction cups have lowered and pulled the sheet involved upon a drive roller and pressure rollers have been pivoted into position to press the sheet against the drive roller to feed the sheet upon a conveyor.

As best shown, FIG. 10A, the pneumatic tube 102 has at each end thereof a bracket 104 . The brackets 104 have vertical extending portions 104*a* which are pivotally mounted above a common axis 105 upon the adjacent lever arms 100*b*. The arms 100*b* have apertures 106 in which coil springs 108 are mounted to engage the bottom surfaces of horizontally extending flanges 104*b* on the brackets 104. The springs 108 push upwardly on the flanges 104*b* to urge the flanges against shoulders on the tops of the arms 100*b*. Normally, the urging of the brackets 104 by the springs 106 positions the suction cups 20 on the pneumatic tube 102 with a given predetermined orientation with respect to the arms 100*b*. When the suction cups 20 are raised near the bottom of the feed opening 19, this orientation is varied by the engagement of the flange 104*b* on one of the brackets with an abutment shoulder formed by a vertically adjustable screw 112 threaded into a mounting body 110 supported on one of the side walls 4 or the feeding apparatus.

Figure 10B:
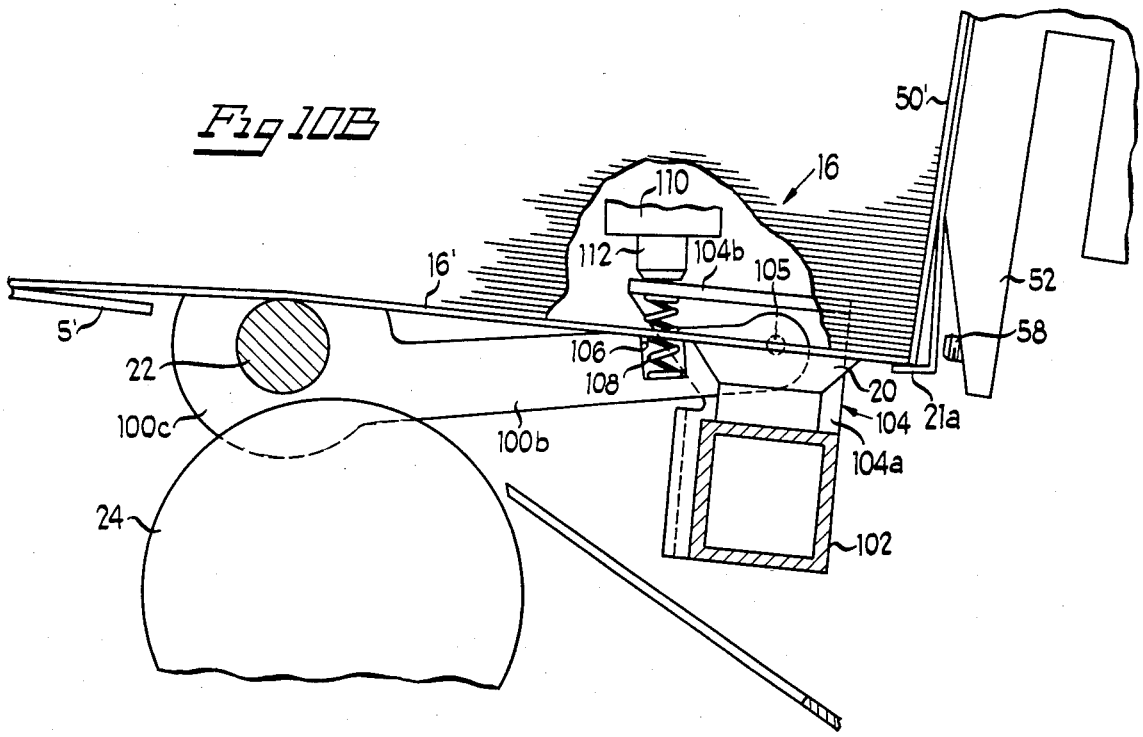
Figure 10C:
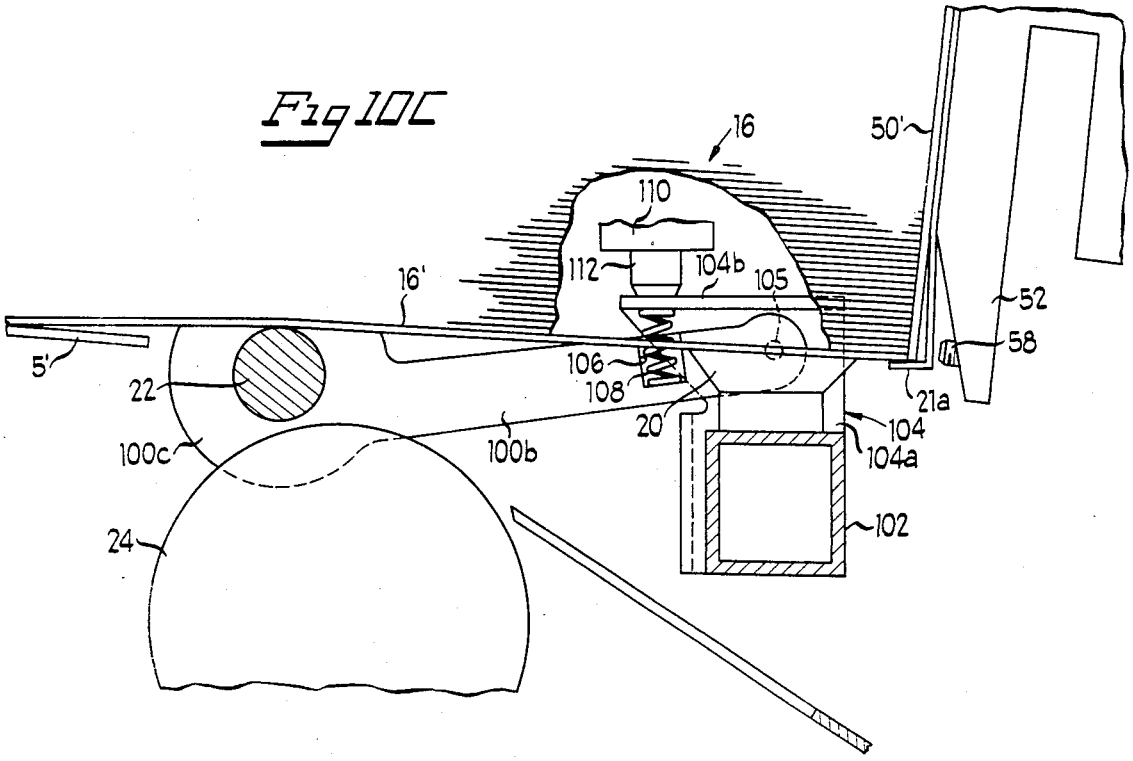
Figure 10D:
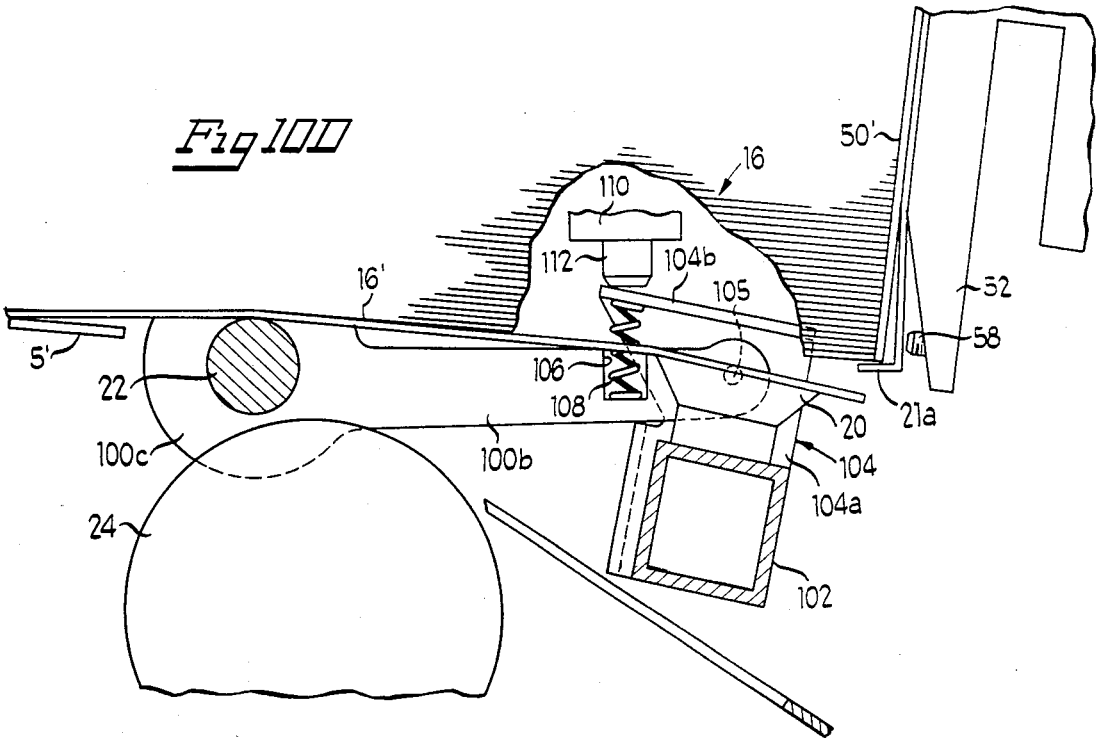
Figure 10E:
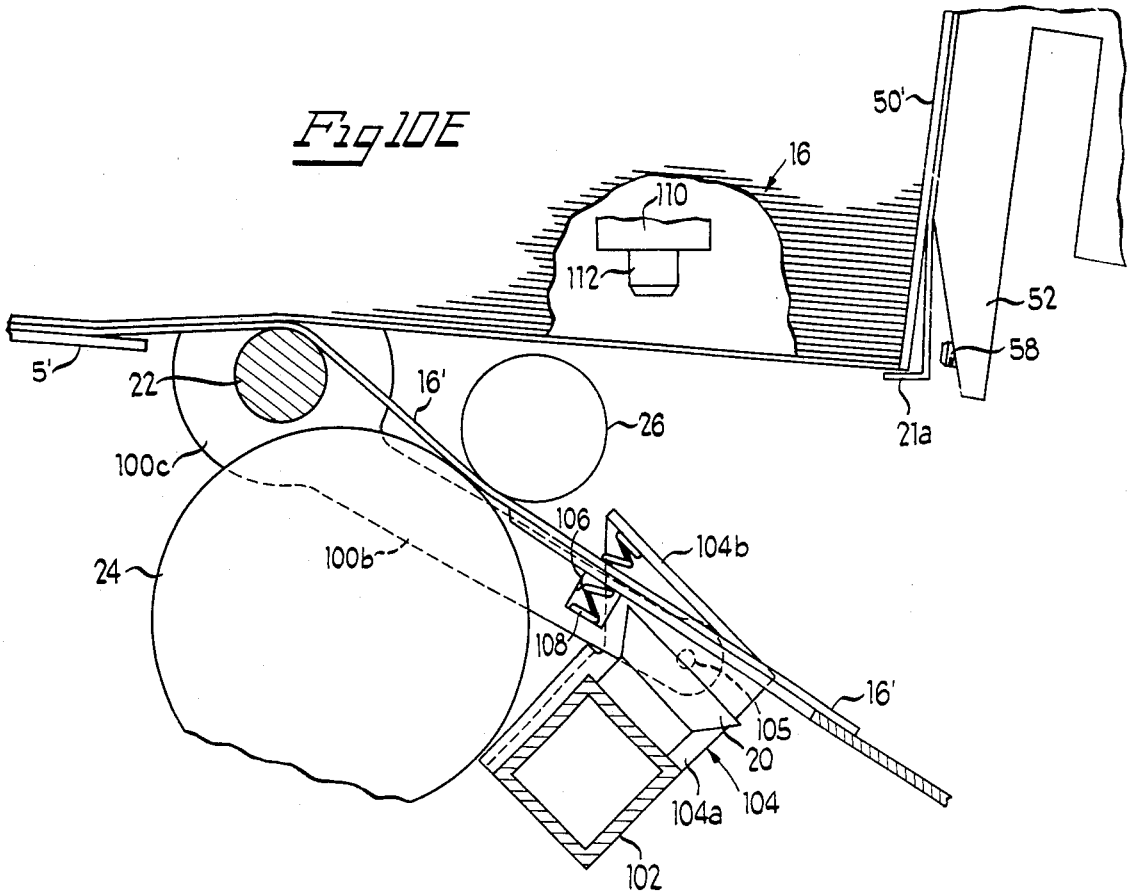
Figure 11:
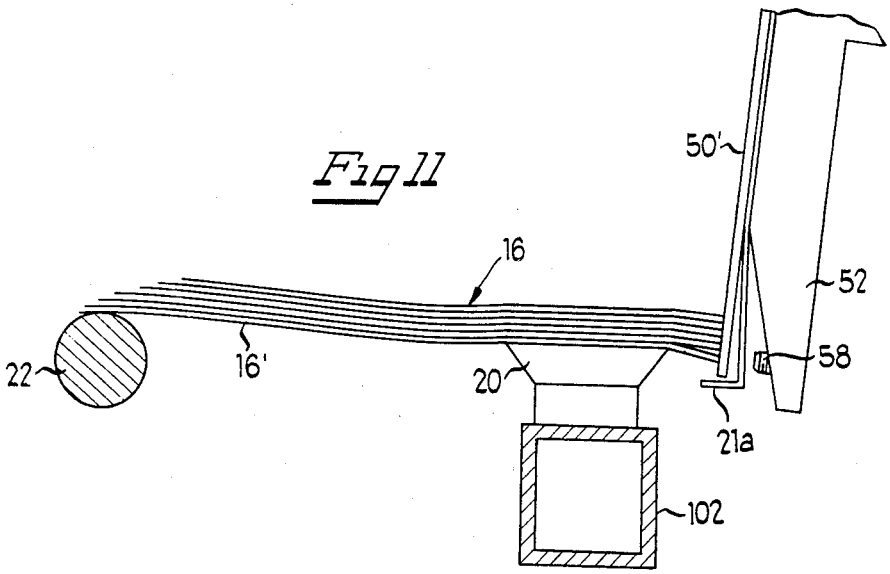
FIG. 11 is a view corresponding to FIG. 10C showing more clearly how the suction cup shown has raised the portion of the stack of sheets engaged thereby.

FIG. 10A shows the relative positions of the link arm 100*b*, the pneumatic tube 102 and the suction cups 20 mounted thereon as the latter flange 104*b* makes initial contact with the abutment shoulder at the end of the adjusting screw 112. It is to be noted that the angle of the suction planes of the suction cups are tilted slightly clockwise with respect to the inclined plane of the bottom surface of the bottommost sheet 16' in the stack of sheets. As the link arms 100*b* are raised to make initial contact between the suction planes of the suction cups and the bottommost sheet 16', these suction planes will be exactly parallel to the bottom of the sheet, as shown in FIG. 10B. This position is reached when the arms 100*b* are raised a small distance from their position in FIG. 10A where the flanges 104*b* have been compressed against return force of the springs 108. To effect a suction cup seal with the sheet 16, and to remove only the bottommost sheet 16' from the stack, the arms 100*b* are raised somewhat above the position shown in FIG. 10B to their uppermost position shown in FIG. 10C, when the flanges are compressed further against the springs 108, where the planes of the suction cups are tilted counterclockwise with respect to the normal inclination of the stack of sheets on the inclined support tray 5'. This raising of the suction cups will, of course, deflect the sheet upward at the point where the suction cups engage the bottommost sheet, as best shown in FIG. 11. As the link arms 100*b* are then lowered, the stream of air issuing from the previously mentioned air discharge openings 64 will tend to keep the bottommost sheet 16', separated from the sheet above the same as the bottommost sheet is then lowered to wipe against the ledge-forming spring lips 21*a*, as shown in FIG. 10D. It should be noted that because of the length and general horizontal position of the link arms 100*b* as they are raised after the suction cups make initial contact with the sheet 16', the suction cups are not moved significantly horizontally away from the spring lips 21*a*, so there is no appreciable force which tends to move the suction cups along the sheet 16' to cause any suction cup slippage to break the suction cup seal with the sheet. When the link arms 100*b* are moved to their fully lowered position shown in FIG. 10E, the suction cups 20 pull the sheet 16' involved down upon the drive roller 24. The pressure rollers 26 will then have been raised into a position above the drive rollers 24 to press the sheet 16' against the drive roller 24 to feed the same to conveyor section 3.

One aspect of the invention involves the manner in which the suction cups 20 are mounted on the pneumatic tube, which will be described shortly. However, it will now be helpful to explain the manner in which the pressure rollers 26 are raised and lowered. Referring now more particularly to FIGS. 2, 4 and 4A, as the clutch shaft 90 rotates the crank 94, a crank arm 126 connected thereto is reciprocated. The crank arm 126 has an adjustable head 128 on the end thereof to which is pivotally connected crank arms 130 and 132, respectively, pivotally connected to a stationary mounting base 134 and a projecting arm 136*a* of a lever member 136 at one end of the sleeve 96', which is separated therefrom. Lever member 136 has a hub 136*b* secured to the shaft 97 on which sleeve 96' is rotatable.

As shown in FIG. 4, there is a link member 136 at the opposite ends of the sleeve 96' connected to shaft 97 for movement therewith. Each of the lever members 136 has an arm 136*c* positioned contiguous to the arm 137*c* of a pressure roller carrying lever member 137 having a hub portion 137*a* rotatably mounted upon the shaft 97 and an arm 137*b* carrying the pressure roller carrying shaft 26'. A spring 138 extends between each arm 136*c* and 137*c*. The springs 138 pivot the roller carrying members 137 in a counterclockwise direction as viewed in FIG. 2 against an abutment wall 139*a* (FIG. 4A) of a member 139 carried by the lever members 136 so that the pressure roller carrying lever members 137 are moved with the link members 136. As lever members 136 are rocked in a counterclockwise direction as viewed in FIG. 4A, the pressure rollers 26 carried on the arm 137*b* are moved from a lowered position as the pneumatic tube 102 is lowered to a raised position, when they press the sheet 16' against drive roller 24. While the shaft 90 which drives the oppositely located cranks 92 and 94 are continuously rotatable, because of the particular locations of the cranks 92 and 94 on the ends of the shaft 90, a small degree of movement in an upward direction is initially imparted to the pressure rollers 26 as the pneumatic tube 102 is being lowered, so that the tube is moved out of the way before the pressure rollers are fully raised. After the pressure rollers 26 first engage the sheet 16' to press the same against the drive roller, as the lever members 136 are then moved counterclockwise still further, the roller carrying arms 137*b* will leave the abutment walls 139*a* so that the springs 138 are placed under added tension to apply spring pressure pressing the sheet being removed against the drive roller 24.

At the beginning of each cycle of operation of the sheet feeding apparatus, the relative positions of the suction cups 20 and the pressure rollers 26 are shown in FIG. 2, where the pressure rollers 26 engage the drive roller 24 and the suction cups 20 are in their relatively lowered position. As the crank shaft 90 starts to rotate at the beginning of a cycle of operation of the apparatus, crank 94 moves to the left as the crank 92 moves to the right. As previously indicated, this will cause the raising of the pneumatic tube 102 and the lowering of the pressure rollers 26. After approximately 180° of rotation of the cranks 92 and 94, the crank arms 95 and 126 are moved in the opposite directions to raise the pressure rollers 26 and lower the suction cups 20.

The control of suction to the suction cups 20 is effected by a control plate 127 as shown in FIG. 2 which is pivotally mounted upon one of the side walls 4 and urged by a spring 127' lightly in a downward direction. The position of the free end of the control plate 127 is determined by upper and lower pins **98*a* and 98*a* on the link 98 associated with the suction cup carrier linkage. The upper pin 98*a* pushes a portion 127*a* of the plate down upon a valve 129 to initiate a valve opening operation to apply suction to the suction cups 20 when they are near the bottommost sheet 16' and the lower pin 98*a* raises the plate from the valve 127 to close the valve and terminate the application of suction to the suction cups when the suction cups are lowered to a point where they have pulled the plate upon the drive roller 24. The initiation of a valve opening operation can be accomplished in any one of a number of well-known ways. Thus the valve may include a snap-action switch which requires the initial downward force of the upper pin 98*a*' to open the valve. Alternatively, the portion 127*a* of the plate 127 may be made of a rubber-like material which must seal over an opening in the top of the valve to provide suction, the sealing of the portion 127*a* requiring an additional downward push by the upper pin 98*a*'** to effect the sealing action.

Reference should now be made to FIGS. 5, 6 and 7 which illustrate the unique manner in which each suction cup 20 is mounted upon the pneumatic tube 102 and the manner in which suction can be individually connected or disconnected from the suction cup. The suction cups 20, which are made of a rubber-like material, are designed to be pulled into place over an enlarged head 121 of a suction cup mounting member 112. Many such members are mounted along the pneumatic tube 102. Each suction cup mounting member 112 includes a cylindrical sleeve portion 114 which is externally threaded to be received within a threaded opening **102*a* in the top of the tube 102. Sleeve portion 114 carries a sealing ring 116 on the bottom thereof so that when the member 112 is fully rotated into a position where it extends to the bottom of the tube, the sealing ring is compressed to seal against the bottom of the tube. The mounting member 114 has an external flange 120 which seats upon the top of the tube 102, and the bottom of the sleeve portion 114 has a pair of openings 118 which communicate with the longitudinal passageway 102*b* of the pneumatic tube 102. Adjustable within the sleeve portion 114 is a vertically adjustable inner sleeve 122 having a central passage 122' communicating with the interior of the sleeve portion 114 and an enlarged tool-receiving bore 124 which may have a hexagonal shape to receive a hexagonally headed tool for rotating the sleeve 122 between a lowered position where the sleeve blocks the openings 118—118 of the sleeve portion 114 and a raised position shown where these openings are unblocked. In the unblocked position of these openings, the central passageway 122' of the sleeve 122 will connect the low pressure longitudinal passageway 102*b* of the tube 102 with the mounth of the suction cup 20 placed over the enlarged head 121 of the mounting member 112**.

Conveyor Section 3

Referring now more particularly to FIGS. 2 and 3, as previously indicated, means are provided for guiding the lateral position of the sheets as they are moved to the stop wall 35. Thus, there is provided a longitudinal vertical guidewall 28' with a flared entry lip **28*a*' and a horizontal bottom flange 28*b*' below the belts 27. In a manner to be described, this guidewall 28' is adjusted so that it extends perfectly longitudinally of the conveyor. There is also provided a similar guidewall 28 with a horizontal bottom flange 28*b* below the belts 27 and a flared entry lip 28*a*. The vertical guidewall 28 is mounted for lateral adjustment along the cross rod 25 extending between the horizontal side walls 4'—4'. The vertical guidewall 28 is carried upon a mounting block 148 (FIG. 12) having a recess 148*a* slidable along the cross rod 25. A clamping screw 150, which threads through an opening 148*b* in the block 148, has a tapered bottom end adapted to engage the cross rod 25 to one side of the center thereof so that when the screw 150 is tightened it will clamp the block 148 in place upon the cross rod 25**.

As shown in FIG. 13, the vertical guidewall 28' is arried upon a similar mounting block 148' having a recess which is slidable along a cross rod 25'. A clamping screw 150' locks the mounting block on the cross rod 25'. The mounting block 148' has a vertical pin 147 passing through a hole **28*c* in the horizontal flange 28*b* so that the guidewall 28' can be pivoted. This block 148' carries an arm 153 through which passes an adjusting screw 155 threaded into an opening 28*c*' in the guidewall 28'. A coil spring 157 is compressed between the confronting surfaces of the arm 153 and the vertical guidewall 28'. As the adjusting screw 155 is rotated within the threaded opening of the guidewall 28', the compression on the spring 157 varies and the end of the screw 155 progressively pivots the guidewall about the pin 147 to adjust the position of the guidewall 28'**.

It has been indicated that the conveyor section 3 carries the pressure rollers 30 and pressure bands 33 which can be adjusted in position like the guidewalls 28 and 28' between the side rails 4' and 4', to accommodate the varying positions of one or more stacks of sheets on the loading section 1. To this end, the rear ends of the bands 33 are connected to a channel member 159 into which threads clamping screw 161 (FIG. 15). A cross rod 140 is provided extending between the side walls 4 upon which rod the channel member 159 is slidable and lockable into position by the tightening of the clamping screw 161. The pressure bands 33 are used primarily with envelopes, as previously indicated. With envelopes it is also useful to urge one edge of the envelope toward the adjustable guidewall 28' by spring pressure. To this end, spring arms **28*a* are attachable to the guidewall 28 so as to project from the guide wall and urge the envelopes involved against the guide wall 28'**.

Front and rear pressure roller means 30 are supported on an overhead carrier assembly 31 which is adjustable for lateral movement along front and rear cross rods 140 and 142. Turning now to FIGS. 2 and 16, each of the rollers 30, which may each be a knurled metal wheel, are rotatably mounted on the end of a spring arm 30′ riveted to a support plate 163. Each spring arm 30′ and support plate 163 have aligned rectangular apertures 30a′ and 163d which are slidably disposed about the rectangular bottom portion 170a of a vertical nut 170 having a flange 170b on the bottom thereof and upon which the spring arm 30′ and plate 163 rest. The nut 170 is slidable within a vertical rectangular opening 168f in a guide rod-receiving member 168. Each spring arm 30′ and plate 163 are urged downwardly against the flange 170b by a coil spring 171 extending between the spring arm 30 and the downwardly facing shoulder 168a of the guide rod-receiving member 168. Each member 168 has curved channels 168b—168b on the top thereof which slidably receive longitudinal guide rods 162 extending through the channels of the rod-receiving members168 associated with both feed rollers 30. Each nut 170 has a portion 170c above the rectangular portion 170a which permits the assembly of the arm 30′ and the plate 163, upon compression of spring 171, to be rotated freely to bring the associated roller 30 on one side or the other of the support rod-receiving member 168. Each nut 170 has a rectangular upper section 170d having a vertical threaded aperture 170e which receives the threaded shank of the screw 166. Rotating the associated screw 166 moves the associated nut 170 upward or downward within the opening 168f which varies the degree of compression of the associated spring 171b to raise or lower the spring arm 30′, causing the roller 30 which varies the force of the roller upon the sheet involved. The head of each screw 166 also clamps the rod-receiving member 168 upon the guide rod 162 in any desired adjusted position along the rods 162. The guide rods 162 extend between head members 160 having curved longitudinal recesses 160a receiving the cross rods 162 and a lateral recess which is placed over the cross rod 140 or 142 along which the entire carrier assembly is laterally adjustable. A clamping screw 164 associated with each head member 160 clamps the same in any one of their adjusted positions along the cross rod 140 or 142.

It would be helpful to summarize the unique combination of features of the conveyor section which renders it so flexible for use in conveying sheets of varying sizes from one or more stacks of sheets in the loading section of the apparatus. Thus, the cross rods 25, 25′, 140 and 142 extending between the side walls 4 constitute a framework along which one or more vertical guidewalls 28 and 28′, one or more roller-carrying overhead carrier assemblies 31, and one or more pressure bands 33 can be adjusted in position laterally across the entire width of the conveyor section. The cross rods 140 and 142 constitute an overhead framework, that is a framework above the belts 27, for adjustably supporting the overhead carrier assembly 31 and the bands 33. The cross rods 25 and 25′ constitute a framework below the sheet carrying plane of the conveyor for supporting the vertical guide walls 28 and 28′ positioned between belts 27 and extending above the same. The support rods 162 of the overhead carrier assembly 31 support for individual longitudinal adjustment therealong the assembly of parts best shown in FIG. 16, which will be sometimes referred to as a roller carrying sub-assembly. Also, each of the roller-carrying spring arms 30, of each sub-assembly is pivotable about a vertical axis between a first fixed position where the associated roller 30 is spaced longitudinally upstream from the pivot axis on the upstream side of the conveyor and a second fixed position upstream where it is longitudinally spaced downstream from the pivot axis. (In these two fixed positions the spring arms 30 urge into a locked position where the square aperture of the spring arm closely fits the similarly square shaped portion 170a of the vertical nut 170.)

Generally, the overhead carrier assembly 31 will be centered with respect to the longitudinal axis of the sheet of material passing therebelow and, where the sheet material are envelopes, the pressure bands 33 will be positioned on opposite sides of and equal distances from the overhead carrier assembly 31. In the case where two stacks of sheets are involved, the arrangement of the vertical guidewalls 28 and 28′, the pressure bands 33, and overhead carrier assembly 31 shown in FIG. 3 would be duplicated along the longitudinal center lines of the two stacks of sheets involved.

It can be seen that the present invention provides an exceedingly reliable and flexible sheet feeding apparatus where all the different parts thereof are readily adjustable to accommodate different operating conditions. Thus, sheets are reliably removed one at a time from the bottom of the stack and delivered with a desired orientation against the stop wall 35 without any "bounce back" because of the rollers 30—30.

What is claimed is:

1. Apparatus for feeding sheets one at a time to a stop wall at the end of the apparatus, the apparatus comprising movable horizontal support means for said sheets which move from an inlet end to an outlet end of the apparatus where said stop wall is located, at least one overhead support means extending above said movable support means and being bodily supported for individual adjustment transversely of the direction of movement of said support means, a roller carrying sub-assembly supported on each overhead support means for longitudinal adjustment thereon, each roller carrying sub-assembly comprising roller means for making rolling engagement with the sheet of material moving on said support means and positioned to prevent "bounce back" thereof as the sheets are moved against said stop wall, resilient arm means on each sub-assembly and carrying said roller means on the end thereof, means for varying the downward force of the roller means upon the sheet moving on the movable horizontal support means, and pressure band means mounted to said overhead support means and extending above and longitudinally of the movable support means for pressing down upon the sheet material thereon simultaneously with the downward pressure of said roller means thereon.

2. The conveyor apparatus of claim 1 wherein there are provided at least two longitudinally spaced roller carrying assemblies supported for longitudinal adjustment on said overhead support means.

3. The conveyor apparatus of claim 1 wherein the resilient arm means carrying each roller means is pivotable about a vertical axis between a first fixed position where the roller means is longitudinally spaced from the pivot axis on the upstream side thereof to a second fixed position where the roller means is longitudinally spaced from the pivot axis on the downstream side thereof.

4. Apparatus for feeding sheets one at a time, said apparatus comprising movable horizontal support means for said sheets which move from an inlet end to an outlet end of the apparatus, at least one overhead support means extending above said movable support means and being bodily supported for individual adjustment transversely of the direction of movement of said support means, a roller carrying sub-assembly supported on each overhead support means for longitudinal adjustment thereon, each roller carrying sub-assembly comprising roller means for making rolling engagement with the sheet of material moving on said support means, resilient arm means on each sub-assembly and carrying said roller means on the end thereto, said resilient arm means carrying each roller means being pivotable about a vertical axis between a first fixed position where the roller means is longitudinally spaced from the pivot axis on the upstream side thereof to a second fixed position where the roller means is longitudinally spaced from the pivot axis on the downstream side thereof.

5. The conveyor apparatus of claim 4 wherein there are provided at least two longitudinally spaced roller carrying assemblies supported for longitudinal adjustment on said overhead support means.

* * * * *